US007744471B2

(12) United States Patent
Parsons

(10) Patent No.: US 7,744,471 B2
(45) **Date of Patent: *Jun. 29, 2010**

(54) TACTICAL DEFENSE DEVICE HAVING BATON AND SPRAY DISPENSING CAPABILITIES

(75) Inventor: Kevin L. Parsons, Appleton, WI (US)

(73) Assignee: Armanent Systems and Procedures, Inc., Appleton, WI (US)

( * ) Notice: Subject to any disclaimer, the term of this patent is extended or adjusted under 35 U.S.C. 154(b) by 879 days.

This patent is subject to a terminal disclaimer.

(21) Appl. No.: 10/625,020

(22) Filed: Jul. 23, 2003

(65) Prior Publication Data

US 2004/0137988 A1 Jul. 15, 2004

Related U.S. Application Data

(60) Provisional application No. 60/398,717, filed on Jul. 26, 2002.

(51) Int. Cl.
*A45B 3/02* (2006.01)
*F41C 9/02* (2006.01)

(52) U.S. Cl. ..... 463/47.4; 463/47.7; 362/102; 42/1.08

(58) Field of Classification Search ..... 463/47.2, 463/47.3, 47.4, 47.5, 47.7; 362/102, 399, 362/187, 205; 42/1.08; 222/3, 192
See application file for complete search history.

(56) References Cited

U.S. PATENT DOCUMENTS 2,124,172 A * 7/1938 Wildes et al. ..... 42/2
2,625,764 A * 1/1953 O'Brien et al. ..... 42/146
3,385,601 A * 5/1968 Black ..... 463/47.4
3,583,609 A 6/1971 Oppenheimer
3,776,429 A * 12/1973 DeLucia ..... 222/162
4,446,990 A 5/1984 Stevenson et al.
5,086,377 A 2/1992 Roberts
5,192,074 A * 3/1993 Ashihara ..... 463/47.4
5,197,734 A * 3/1993 Ashihara ..... 463/47.4
5,363,285 A * 11/1994 Wideman ..... 362/102
5,420,766 A 5/1995 Hollis
5,446,985 A * 9/1995 Chen ..... 42/1.08
5,509,581 A 4/1996 Parsons
5,529,215 A * 6/1996 Banks et al. ..... 222/113

(Continued)

*Primary Examiner*—William M Pierce
(74) *Attorney, Agent, or Firm*—Husch Blackwell Sanders LLP Welsh & Katz

(57) ABSTRACT

A non-threatening combination baton and spray dispenser that can be readily employed was a baton or as a dispenser without requiring complex re-orientation or concentrated aiming, including an expandable baton having a mounted connector coupling that facilitates connection to an end of an irritant spray dispenser disposed in axial alignment with the baton. The connector coupling supports a switch mechanism readily operable by the user's thumb while grasping the connector coupling to selectively dispense spray axially from the dispenser with the baton in either its retracted or expanded positions. The dispenser preferably utilizes the barrel and lens support end of a flashlight to facilitate use as a flashlight or for conversion to receive a pressurized chemical irritant cartridge, and enables selective interchangeability of nozzle plates of different color exposed surfaces to simulate a flashlight lens, provide a dark, non-reflective color during night maneuvers, or use a bright color so that a subject is readily aware that an irritant spray dispenser is pointed at him. The switch mechanism includes a safety button selectively operable to prevent unintended actuation of the dispenser.

38 Claims, 5 Drawing Sheets

U.S. PATENT DOCUMENTS 5,629,679 A 5/1997 Cranford et al.
5,673,819 A * 10/1997 Brunswig ..... 222/113
5,683,168 A 11/1997 Teig et al.
5,839,624 A 11/1998 Parsons
5,842,602 A * 12/1998 Pierpoint ..... 222/1
5,901,723 A 5/1999 Ames
5,934,518 A 8/1999 Stern et al.
6,283,609 B1 * 9/2001 Parsons et al. ..... 362/187
6,386,726 B1 * 5/2002 Macierowski et al. ..... 362/102
6,786,368 B2 9/2004 Cellini et al.
7,000,807 B2 * 2/2006 Cellini et al. ..... 222/402.11

* cited by examiner

TACTICAL DEFENSE DEVICE HAVING BATON AND SPRAY DISPENSING CAPABILITIES

CROSS-REFERENCE TO RELATED APPLICATIONS

The present application claims priority from provisional application Ser. No. 60/398,717, filed Jul. 26, 2002, entitled "Tactical Defense Device Having Baton and Fluid Dispensing Capabilities," which is incorporated herein by reference in its entirety.

BACKGROUND OF THE INVENTION

The present invention relates generally to defense devices as used by law enforcement and military personnel, and more particularly to a tactical defense device that can be used as a baton or used to dispense a spray, such as a chemical irritant.

It is a common practice for law enforcement and military personnel to carry a baton when their assignments place them in situations where they may be subject to personal confrontations, or to physical attacks. Such batons normally include two or more telescoping sections that can be carried in a retracted condition and expanded to provide significantly greater reach when confronted with a threatening situation. See, for example, U.S. Pat. No. 5,407,197 that is assigned to the assignee of the present invention and incorporated herein by reference.

It is also a common practice for law enforcement and military personnel to carry flashlights. Because of their universal use, flashlights do not appear threatening and have easy-to-recognize shapes. More recent practice has provided flashlights that may be axially attached to a baton so that law enforcement officers on field duty may utilize either the flashlight or baton, or both, depending on the particular situation. See, for example, U.S. Pat. No. 6,283,609 that is assigned to the assignee of the present invention and incorporated herein by reference.

Another practice common to law enforcement and military personnel is to carry a chemical dispensing device operative to dispense a chemical irritant which, when discharged in the general direction of a person's face, at least temporarily impairs the person's sight and breathing so as to reduce the threat of harm to law enforcement personnel. Chemical irritant dispensers are well known. Such dispensers typically employ a large aerosol canister containing an aerosol pepper spray or other irritant, such as, for example, the MACE brand of chemical irritant spray manufactured by Mace Security International. When used by law enforcement personnel and individuals requiring on-the-job protection, such as postal service workers, delivery persons and the like, the dispensers generally are carried in holsters worn on a belt or uniform.

Typically, some known dispensers are held in a vertical position when deployed, much like a handheld aerosol paint dispenser. Such dispensers have the disadvantages that they are easily identifiable, and unless they are properly aimed, it is possible to inadvertently dispense the chemical spray on oneself. Because chemical irritant dispensers are generally activated under stressful conditions, the requirement for conscientious and accurate arming is a significant drawback. Moreover, the need for deliberate aiming and firing reduces or eliminates the element of surprise, and permits an adversary to prepare for or avoid the spray. Recent advances to overcome such drawbacks include the provision of a chemical irritant dispenser that can be readily held in one's hand and actuated by the user's thumb to release or discharge the chemical irritant while holding the dispenser in a horizontal position while gripped in the user's hand. See, for example, U.S. Pat. No. 5,509,581, which discloses such a device.

It is also known to combine a spray dispenser with a baton so as to enable dual functioning as either a baton or a liquid irritant dispenser. The known combination baton and spray dispenser devices have proven rather cumbersome and do not lend themselves to rapid re-orientation such as, for example, switching from use as a baton to use as a spray dispenser. Further, known combination baton and spray dispensers are dedicated to these two functions, and do not provide for easy conversion of the dispenser to a flashlight, and vice versa.

It thus follows that a combination baton and defensive spray dispenser that appears in a non-threatening form, such as a flashlight, that may be converted rapidly from use as a baton to use as an irritant spray dispenser, and that facilitates accurate arming and ease of operation would enhance the use and safety value for law enforcement and military personnel. Police officers using a flashlight or an ASP Tactical Baton are taught to rest the light or baton on their shoulder with the lens of the light or shaft of the baton facing the subject and the barrel of the light or shaft of the baton extending backward over the officer's shoulder. From this non-threatening position, the officer can ward off blows or attacks, and strike with the barrel of the light or extend and strike with the shaft of the baton.

SUMMARY OF THE INVENTION

One of the objects of the present invention is to provide a tactical defense device in the form of a combination baton and spray dispenser that can be readily employed as a baton or as a dispenser without requiring complex re-orientation of the device for either function. The present invention allows officers to immediately escalate from the use of a chemical irritant to the use of an impact weapon.

A more particular object of the invention is to provide a combination baton and spray dispenser employing a connector coupling that can be connected to a conventional baton and to an irritant spray dispenser disposed in axial alignment with the baton. The connector coupling has a switch mechanism readily operable by a user's thumb or finger while grasping the connector coupling in the user's hand to selectively dispense spray axially from the dispenser.

A feature of the present invention lies in the ability to use the spray dispenser as a non-lethal tactical defense device, which has the appearance of a flashlight so as not to appear outwardly threatening to a subject or adversary during use. Another feature of the present invention is the ability to use the spray dispenser in combination with a baton to facilitate use of either device in a single tactical defense device.

Yet another feature of the spray dispenser in accordance with the invention lies in the interchangeability of nozzle plates at the dispensing end of the dispenser that enables use of different color exposed nozzle surfaces. For example, a shiny nozzle surface may be used to simulate a flashlight lens, thus concealing the fact that the user may be pointing an irritant dispenser at a subject. Alternately, a dark, non-reflective color may be used during a maneuver undertaken at night, or a bright color may be used to enable a subject to be readily aware that an irritant spray device is pointed at the subject.

Another feature of the present invention lies in the provision of a connector coupling, which is adapted for connection to the rear end of the irritant dispenser spray and that includes a switch mechanism operative to actuate a spray cartridge longitudinally in linear relation to generally radial actuation of a switch button relative to the axis of the coupling. The switch button is movable when the connector coupling is grasped by either hand of the user between a safety position, which prevents actuation of the spray dispenser, and a release position, which enables actuation of the spray dispenser.

Yet another feature of the combination baton and spray dispenser in accordance with the invention lies in the ability to readily adapt a flashlight portion of a combination baton and flashlight, such as the device disclosed in U.S. Pat. No. 6,283,609 and incorporated herein by reference, to an irritant dispenser. Common components of the flashlight are utilized, thereby significantly reducing manufacturing costs.

Further objects, features and advantages of the present invention, together with the organization and manner of use thereof, will become apparent from the following description of the invention when taken in conjunction with the accompanying drawings wherein like reference numerals designate like elements throughout the several views.

While the present invention is susceptible to various modifications and alternative forms, specific embodiments thereof are shown by way of example in the accompanying drawings and will be described in detail. It should be understood that the drawings and detailed description thereof are not intended to limit the invention to the particular form disclosed, but rather the invention is intended to cover all modifications, equivalents and alternatives falling within the sprit and scope of the present invention.

DETAILED DESCRIPTION

Figure 1:
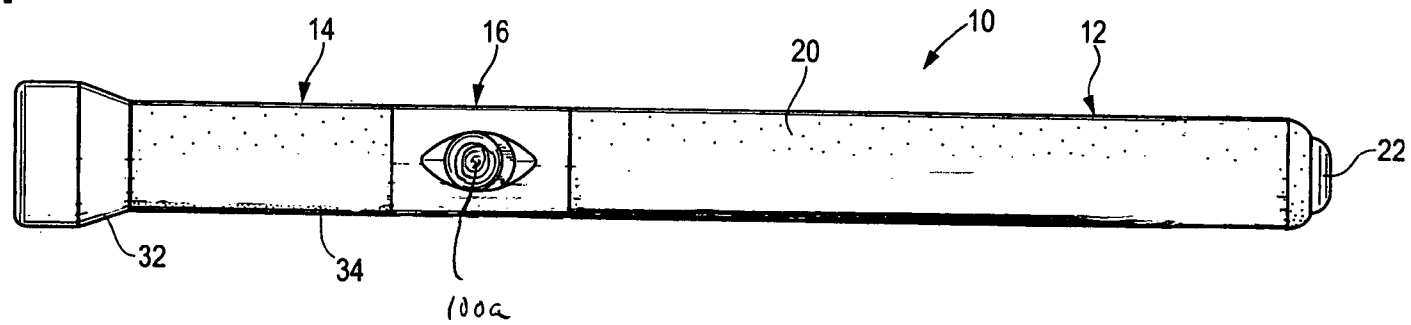
FIG. 1 is a plan view of a combination baton and spray dispenser in accordance with a preferred embodiment of the present invention.

Referring now to the drawings, and in particular to FIGS. 1-4, a tactical defense device having baton and spray dispensing capabilities in accordance with the present invention is indicated generally at 10. The tactical defense device 10 includes a baton portion 12, a spray dispensing portion 14, and a connector coupling 16. The connector coupling 16 houses a switch mechanism 13 selectively operable to dispense an irritant from a dispenser cartridge 40 disposed in the spray dispensing portion 14, such as aerosol pepper spray or other irritant. The tactical defense device 10 is particularly useful by law enforcement and military personnel as a non-lethal tactical device to temporarily incapacitate or fend off an aggressive adversary or attacker, or otherwise assist in control of highly charged crowds through dispensing a spray irritant to cause temporary debilitation, by inhibiting sight, and causing significant irritation of breathing passages.

The baton portion 12 of the device 10 is of known construction, such as disclosed in U.S. Pat. No. 5,407,197 that is incorporated herein by reference. The baton 12 is expandable, having a cylindrical tubular handle 20, which may receive one or more telescoping tubes and a central rod (not shown) adapted to telescope with the handle 20. The innermost telescoping rod has a tip end 22, that may be removable and replaceable with a tip of a different configuration. The opposite end 23 of the baton handle 20 has an external male thread formed thereon (FIG. 4), adapted to receive the connector coupling 16 in threaded connection thereon.

An end cap 15 (FIG. 2) may be provided to form a closed end for the device 10 when it is not coupled to a baton 12. The end cap 15 of the tactical device 10 is of known construction, with an external male thread 17 formed thereon, and adapted to receive the connector coupling 16 in threaded connection thereon. An end cap (not shown) also may be provided for the opposite end 23 of the baton handle 20, to form a closed end of the baton 12 when not used in combination with the spray dispenser 14.

Preferably, the spray dispenser portion 14 utilizes a cylindrical tubular flashlight body similar or identical to that disclosed in U.S. Pat. No. 6,283,609 so as to present the appearance of a flashlight, which may render the spray dispenser's appearance non-threatening. Conversion of a pre-existing cylindrical tubular flashlight body to a spray dispenser portion 14 by replacing the flashlight's reflector, switch housing, and batteries also may significantly reduce manufacturing costs.

Figure 3:
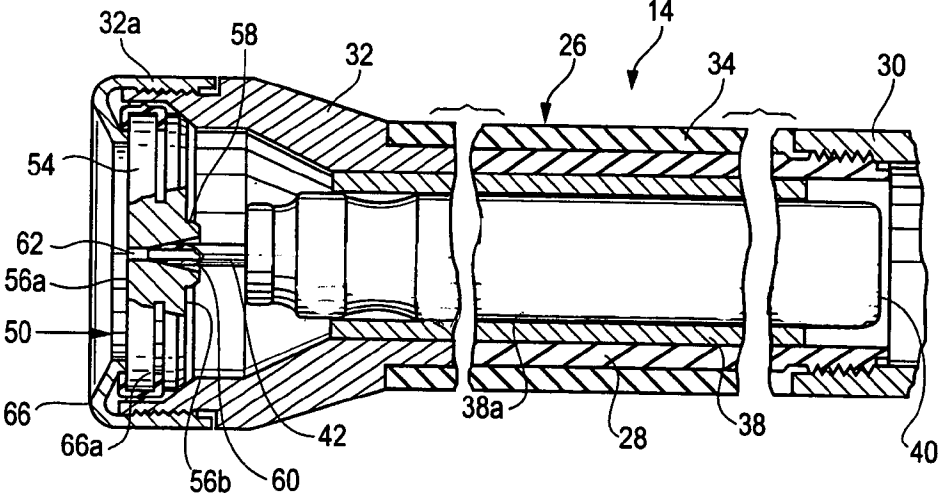
FIG. 3 is an elevational sectional view of the spray dispenser of FIG. 2 with the connector coupling removed.
Figure 2:
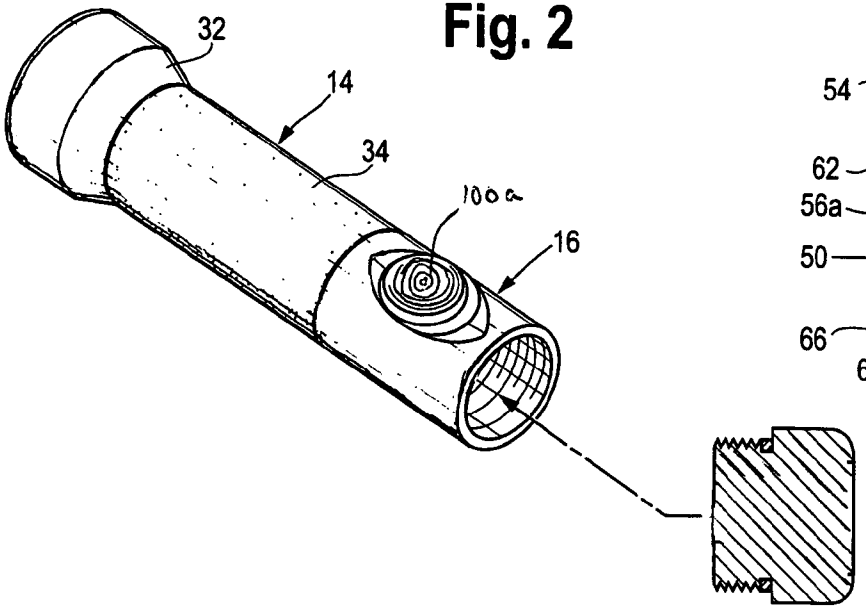
FIG. 2 is a perspective view of a spray dispenser in accordance with a preferred embodiment of the present invention, with an elevational sectional view of an end cap adapted to optionally be mounted in the outer end of the connector coupling when no baton is attached.

Referring particularly to FIGS. 2 and 3, the spray dispenser 14 has a generally tubular body 26 that includes a cylindrical tubular metallic portion 28 having an external male thread 30 (FIG. 4) formed on its rearward end. The cylindrical tubular portion 28 preferably terminates at its forward end in a generally outwardly diverging conical portion 32 having an external annular male thread 32*a* formed on its forward end.

The cylindrical tubular portion 28 of the dispenser preferably has an annular cover sleeve 34 formed along its length, which may be molded or applied thereon, and which may be formed of a material suitable to enhance gripping of the spray dispenser 14. The cover sleeve 34 may also be bonded to the cylindrical tubular portion 28, as is known. The cover sleeve 34 provides a universal gripping surface preferably with 360 degree coverage about the circumference of the cylindrical tubular portion 28.

In the illustrated embodiment, the tubular body 26 may have an annular sleeve or tube 38 inserted within the cylindrical metallic portion 28. The sleeve 38 may be used if a non-standard size aerosol canister 38 is used. Preferably, the sleeve 38 is not needed when a standard size aerosol canister 38 is used. The sleeve 38 has an outer diameter that enables the sleeve to be slidingly inserted within the cylindrical body 28, and has an internal cylindrical bore 38*a* sized to receive the cylindrical aerosol canister 40. The sleeve 38 may be sized with respect to its internal diameter to permit aerosol canisters 40 of different diameters to be received. Preferably a canister of standard size may be approximately 3-5 inches in length and one-half inch in diameter. The sleeve 38 preferably is made of a non-corrosive material, such as a suitable plastic, that is unaffected by the irritant or other substance contained within the aerosol canister or container 40. The canister 40 has a length such that a forward end terminates at the mouth of the diverging conical portion 32 of the cylindrical portion 28, and terminates at a rearward end 41 short of the rearmost end 29 of the cylindrical portion 28, as shown in FIG. 3. The outward divergence of the conical portion 32 protects the user from exposure to the irritant contained within the canister 40, and prevents the device 10 from sliding out of the user's hand.

The aerosol canister 40 may be of the type disclosed in U.S. Pat. No. 5,509,581, which is incorporated herein by reference in its entirety. The aerosol canister has a tubular discharge nozzle 42 at its forward end operative to release the pressurized contents of the canister 40 when the discharge nozzle 42 is depressed axially inwardly of the canister.

Figure 4:
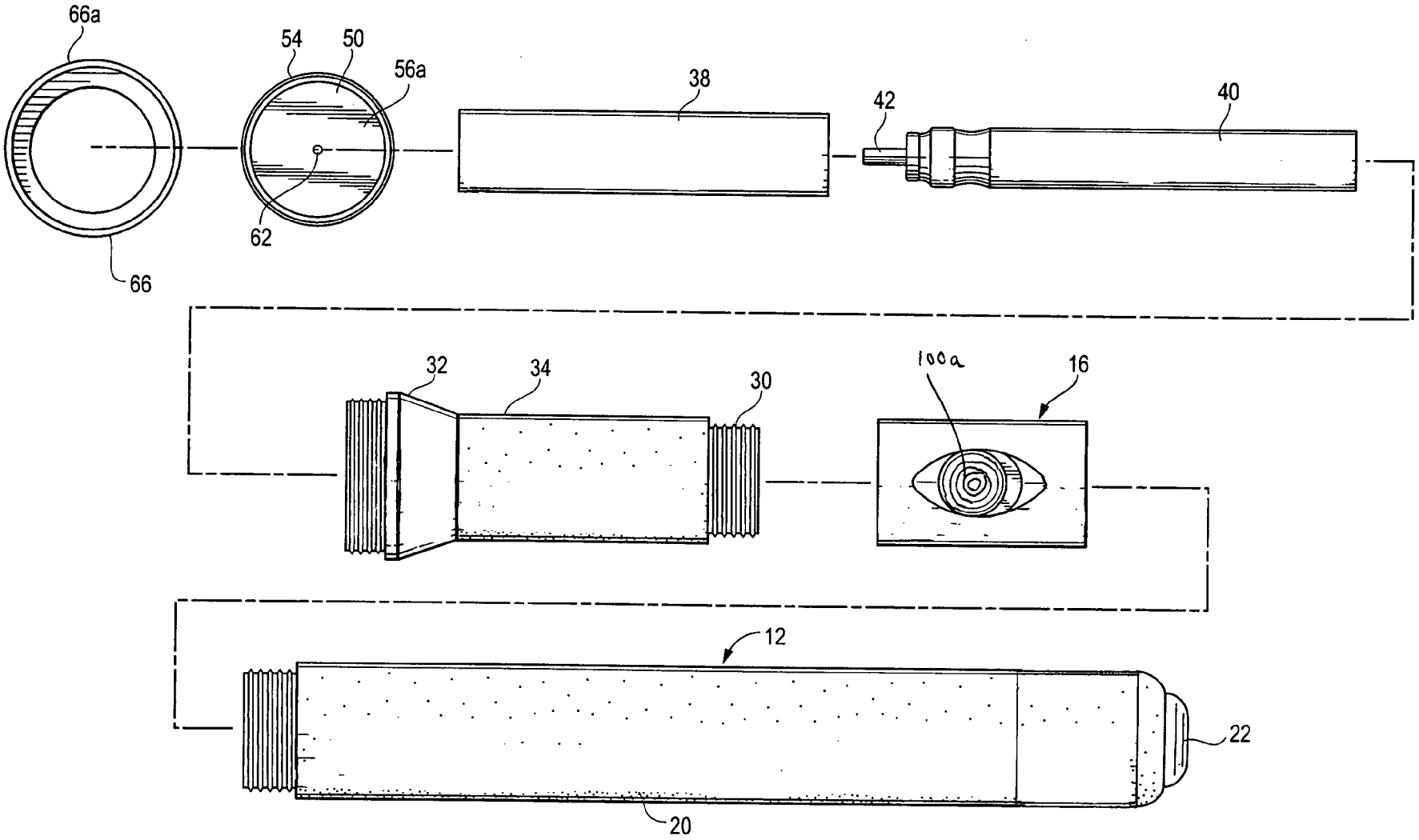
FIG. 4 is an exploded plan view of the combination baton and spray dispenser illustrated in FIG. 1 showing assembly of the tactical defense device.
Figure 8:
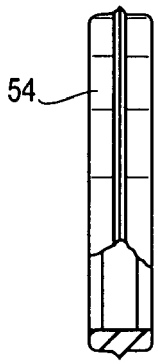
FIG. 8 is an edge elevational view of an elastomeric seal for mounting on the periphery of the nozzle plate of FIGS. 6 and 7.
Figure 7:
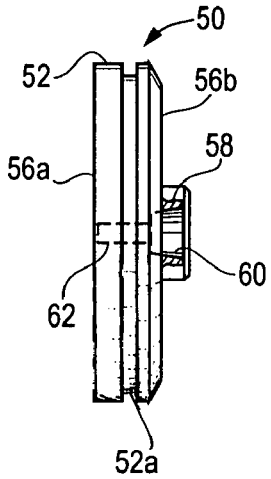
FIG. 7 is an edge view of the nozzle plate of FIG. 6.
Figure 6:
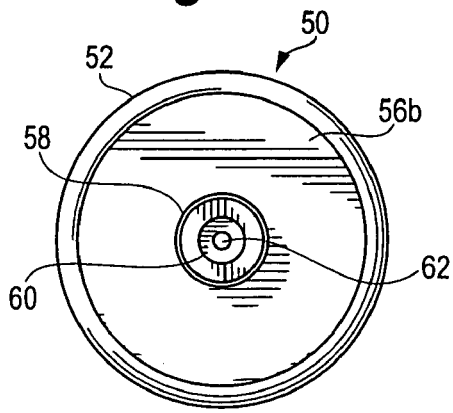
FIG. 6 is an elevational view of a nozzle plate employed at the discharge end of the spray dispenser.
Figure 10:
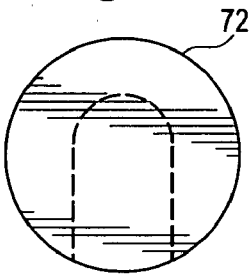
FIG. 10 is an end elevational view of the actuator plunger of FIG. 9.
Figure 9:
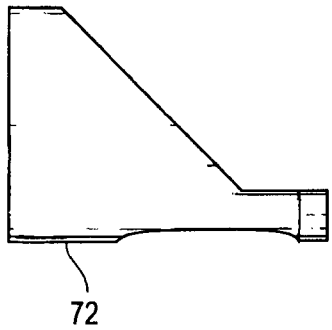
FIG. 9 is a side elevational view of an actuator plunger employed in a switch mechanism within the connector coupling.
Figure 11:
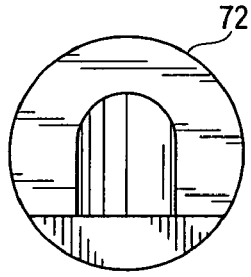
FIG. 11 is an end elevational view of the opposite end of the actuator plunger of FIG. 9.

In the illustrated embodiment, the forward end 31 of the conical portion 32 of the tubular body 26 is adapted to support a circular nozzle plate 50 (see FIGS. 3, 6 and 7). The nozzle plate 50 preferably is made of a non-corrosive material, such as aluminum, and has an outer annular surface 52 in which is formed an annular groove 52*a*. An annular resilient seal member 54, best illustrated in FIG. 8, is configured to cooperate with the annular surface 52 of the nozzle plate 50, and has inwardly directed peripheral edges 54*a* and 54*b*, which seat within the groove 52*a* and extend about the outer peripheral edge of the face of the nozzle plate 50, respectively, so as to be retained on the nozzle plate 50, as shown in FIG. 4.

The nozzle plate 50 has opposite parallel planar surfaces 56*a* and 56*b*, respectively referred to as the outer planar exposed surface and the inner planar surface of the nozzle plate 50. A generally cylindrical boss 58 is formed on the inner planar surface 56*b* so as to extend coaxially rearwardly from the inner planar surface, as illustrated in FIG. 7. The cylindrical boss 58 has a countersunk orifice 60 partially formed through the thickness of the boss 58. A smaller diameter discharge orifice 62 extends coaxially through the thickness of the boss 58 and through to the outer exposed surface 56.

Referring again to FIG. 3, the nozzle plate 50 and associated external seal member 54 are sized so as to be snugly received within an annular surface formed within the forward end portion 32 of the dispenser body 26. Thus, the discharge orifice 62 and associated countersunk orifice 60 are coaxial with the longitudinal axis of the cylindrical tubular portion 28. The nozzle plate 50 is retained within the forward end of the dispenser body 26 by an annular retainer 66 having an internal thread 66*a* adapted for threaded cooperation with the external thread 32*a* on the forward end of the conical body portion 32.

One preferable feature of the present invention lies in the provision of a plurality of nozzle plates 50 having different color outer exposed surfaces 56*a*. For example, forming a silver-colored coating over the outer exposed surface 56*a* simulates a flashlight lens so that in a lighted environment, law enforcement personnel could aim the spray dispenser 14 toward a subject, who may consider the reflective surface of the nozzle plate 50 to be a flashlight lens, and thus may be less apt to flee to evade a discharged spray of irritant. An alternative nozzle plate 50 may be provided having a generally dark or black non-reflective surface 56*a* so that when the spray dispenser 14 is aimed at a subject in a darkened environment, the subject cannot detect whether the irritant spray dispenser is an actual spray dispenser or whether it is a flashlight, thus again enabling the officer to approach the subject and obtain a shorter spray distance in the event it is necessary to discharge irritant from the dispenser. A still further embodiment is to provide a nozzle plate 50 having a bright, highly visible color on the exposed surface 56*a*, such as a red color, so that a subject readily may detect that the dispenser 14 is not a flashlight, thus becoming less active when confronted by the officer, knowing that he could be subjected to a debilitating irritant spray.

Figure 5:
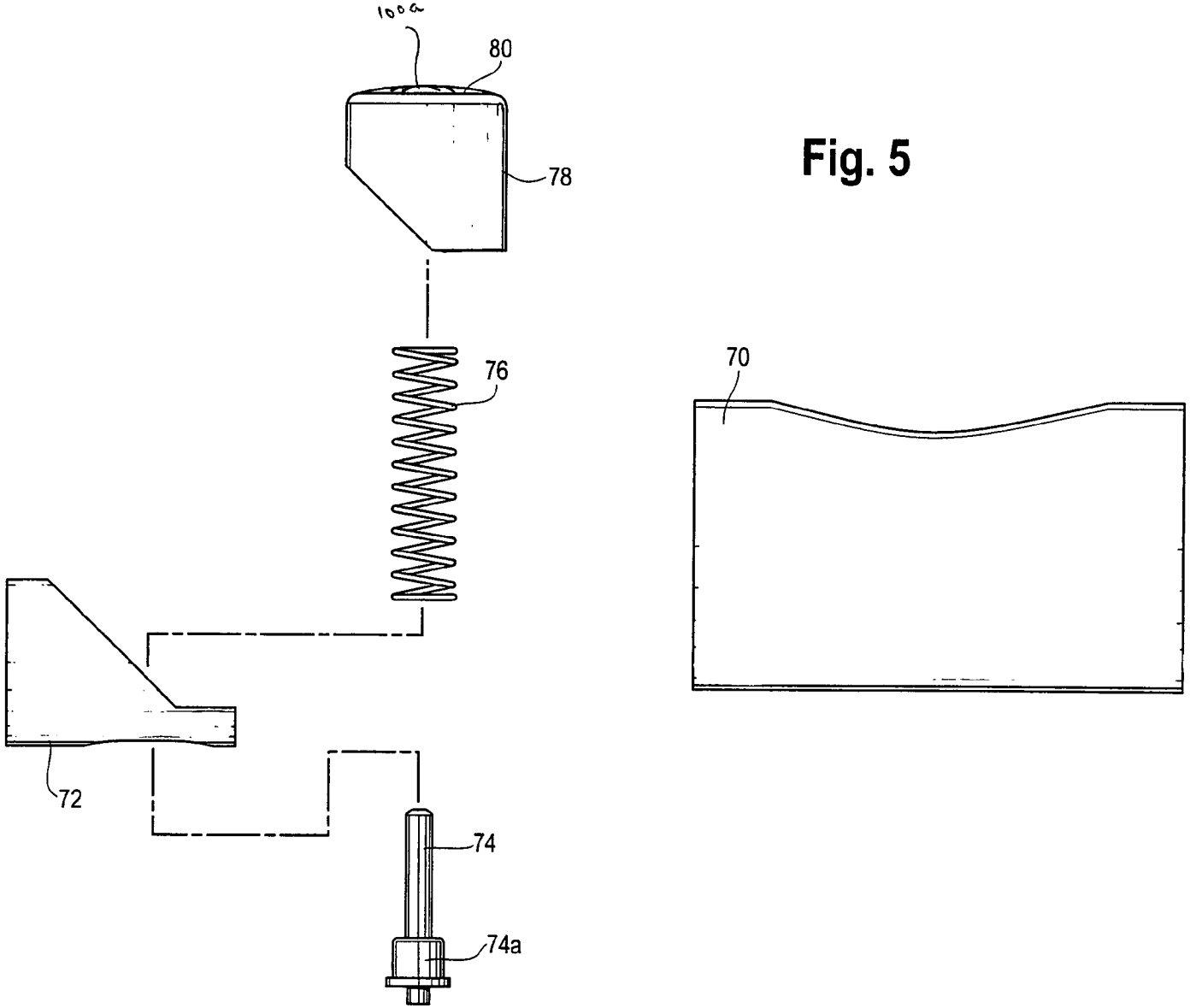
FIG. 5 is an exploded view illustrating the components of the connector coupling for connecting the spray dispenser to a baton or to an end cap.

Referring now to FIG. 5, taken in conjunction with FIGS. 9-22, the connector coupling 16 includes a generally hollow cylindrical plunger housing 70 configured to receive a plunger actuator 72 (shown in greater detail in FIGS. 9-12), a guide pin 74, a coil compression spring 76, and an actuator button 78 that carries a safety slide button 80.

Figure 12:
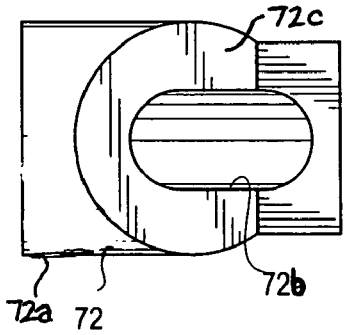
FIG. 12 is a plan view of the actuator plunger of FIG. 9.
Figure 13:
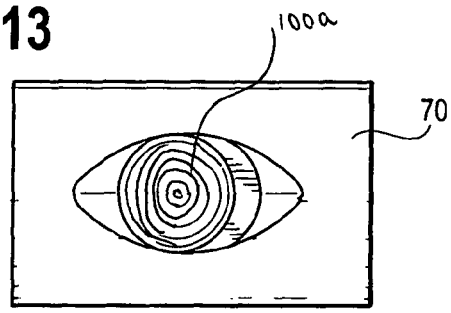
FIG. 13 is a plan view of the connector coupling housing employed in the spray dispenser and baton device of FIG. 1, and the spray dispenser device of FIG. 2.
Figure 15:
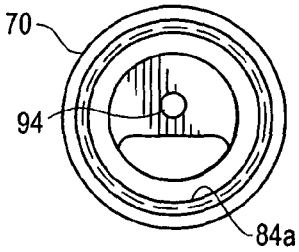
FIG. 15 is an elevational view as viewed from the left-hand end of the connector coupling housing illustrated in FIG. 14.
Figure 14:
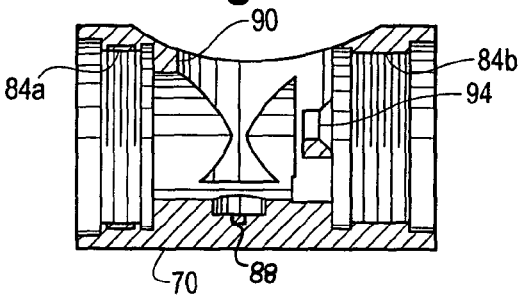
FIG. 14 is an axial sectional view of the housing of FIG. 13.
Figure 16:
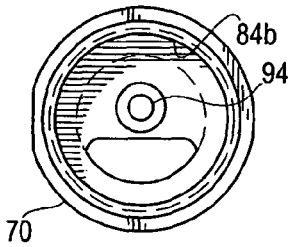
FIG. 16 is an elevational view of the connector coupling housing of FIG. 13 as viewed from the right-hand end of FIG. 14.
Figure 19:
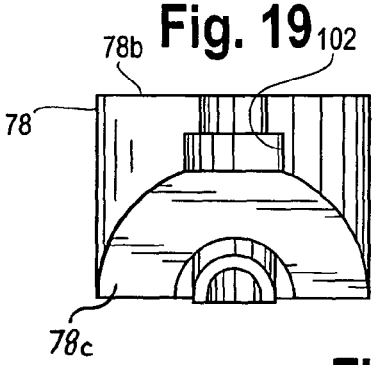
FIG. 19 is a front view of the actuator button of FIG. 17.
Figure 17:
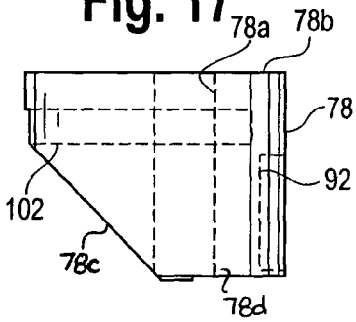
FIG. 17 is a side view of an actuator button employed in the switch mechanism for the dispenser, with portions broken away for clarity.

As illustrated in FIGS. 14-16, the cylindrical plunger housing 70 of the connector coupling 16 has internal female threads 84*a* and 84*b* formed on opposite ends, which are adapted to receive and mate with the external threaded end 30 (FIG. 4) of the tubular body 26 (FIG. 3) and the external thread formed on the opposite end 23 (FIG. 4) of the baton handle 20 (FIG. 4) so as to interconnect the baton portion 12 (FIG. 4) to the spray dispenser portion 14 (FIG. 4). Alternatively, the connector coupling 16 may receive and mate with the external threaded portion 17 (FIG. 2) formed on the end cap 15 (FIG. 2), if no baton 12 is attached to the spray dispenser 14. The plunger housing 70 has a cylindrical bore 86 adapted to slidingly receive a cylindrical outer surface portion 72*a* (FIG. 9) of the plunger actuator 72 (FIG. 9) so as to enable axial movement of the plunger actuator. As shown in FIGS. 12 and 14, the plunger actuator 72 has an elongated opening 72*b* extending transverse to its longitudinal axis that receives an enlarged diameter portion 74*a* of the guide pin 74 that is inserted into the plunger housing 70 so that a lower flange end of the guide pin 74 is received within a recess 88 formed within the plunger housing 70.

When the plunger actuator 72 is mounted within the plunger housing 70 with the guide pin 74 extending upwardly through the elongated opening 72*b*, an actuator button 78 may be inserted downwardly over the guide pin 74 so that the guide pin 74 extends through a cylindrical bore in the actuator button 78. The plunger housing 70 has a cylindrical bore 90 transverse to its other bore axis 86 to slidably receive an outer cylindrical surface on the actuator button 78, and thereby guide the actuator button 78 as it is moved vertically on the guide pin 74. The plunger actuator 72 and actuator button 78 have mutually cooperating beveled surfaces 72*c* and 78*c*, respectively, that sliding engage with each other so that depressing the actuator button 78 against the upward bias of the spring 76 effects axial movement of the plunger actuator 72 along the center axis of the plunger housing 70 so as to engage and push the canister 40 forward within the cylindrical tubular portion 28. As the tubular discharge nozzle 42 of the canister 40 contacts the nozzle plate 50, the tubular discharge nozzle partially retracts, emitting the chemical irritant through the discharge orifice 62.

Figure 18:
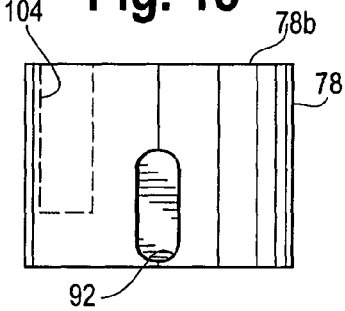
FIG. 18 is a back view of the actuator button of FIG. 17.
Figure 20:
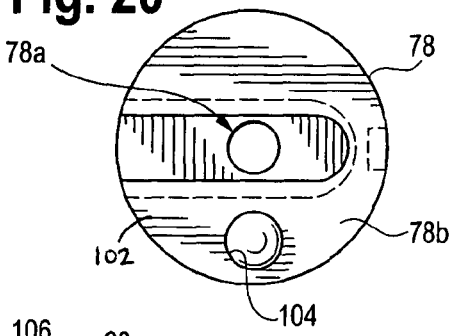
FIG. 20 is a plan view of the actuator button of FIG. 17.
Figure 21:
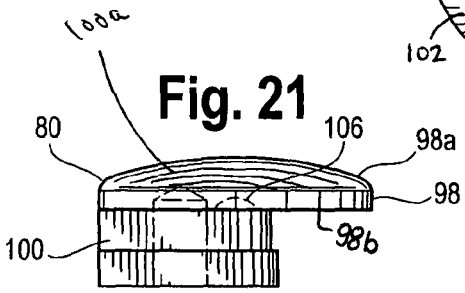
FIG. 21 is an elevational view of a safety slide button employed with the actuator button of FIG. 17.
Figure 22:
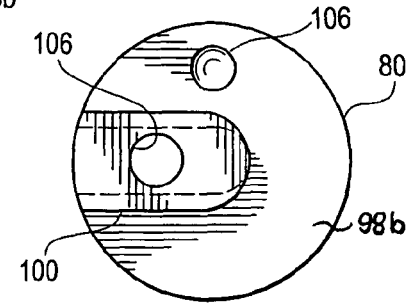
FIG. 22 is a bottom view of the safety button of FIG. 21.

Referring now to FIGS. 14, 15, 16, and 18, movement of the actuator button 78 is limited in its outward position relative to the plunger housing 70, and thereby also limited relative to the plunger actuator 72, by a suitable stop screw (not shown) that is threaded into a threaded bore 92 formed in the plunger housing 70. The inner end of the screw is sized and configured to enter a longitudinal slot or groove 94 formed in the outer surface of the actuator button 78, as best seen in FIG. 18. The upper end of the slot 94 is established to enable downward depression of the actuator button 78 sufficient to effect the desired axial movement of the plunger actuator 72. The lower end of the slot 94 is established to engage the inner end of the stop screw when the actuator button 78 has disengaged from the plunger actuator 72. The compression spring 76 is disposed coaxially on the guide pin 74 and extends into an annular groove 78*d* in the actuator button 78 to bias the actuator button 78 to its outward position relative to the plunger housing 70.

Referring now to FIGS. 3 and 19-22, a feature of the actuating mechanism for the irritant spray canister 40 is the safety slide button 80 which cooperates with the actuator button 78 to enable a natural depressing of the actuator button for selectively dispensing spray irritant from the canister 40. The safety slide button 80 may be moved to a safety position preventing depression of the actuator button 78. The safety slide button 80 has a circular cap portion 98 of a diameter equal to the diameter of the upper end of the actuator button 78. The cap portion 98 has an upper convex or crowned surface 98*a* and a bottom planar surface 98*b* on which is formed a depending retainer leg 100. The retainer leg 100 allows the cap portion 98 to slide longitudinally to the connecter coupling 16, but prevents rotational movement. The upper convex surface 98*a* of the cap portion 98 preferably has raised concentric rings 100*a* formed on its surface to facilitate tactile feedback and control with respect to the user's thumb grip on the safety slide button 80. The concentric rings 100*a* are preferably raised or "step-like" in contour to facilitate the user's grip on the safety slide button. The rings 100*a* facilitate a positive and slip-proof grip.

The retainer leg 100 has a generally inverted "T" shape in transverse cross section, and is adapted to be slidingly received in a similarly shaped slot 102 formed in the actuator button 78 so as to intersect an upper surface 78*b*. The retainer leg 100 and slot 102 are sized to enable sliding movement of the safety slide button 80 between a first position and a second position. In the first position, the cap portion 98 is coaxial with the actuator button 78 to permit discharge of irritant spray from the dispenser 14. In the second position, the cap portion 98 is offset from its coaxial position so as to overlie and engage a surface on the plunger housing 70 in a manner to prevent depressing or actuation of the actuator button 78, thus preventing inadvertent discharge of irritant spray from the dispenser 14. However, should the tactical defense device 10 be seized by an adversary from a user while the safety button 80 is at an "armed," rather than a "safe" setting, the adversary may spray himself with irritant during the struggle, as the discharge orifice 62 of the nozzle plate 50 would be pointed in his direction.

Preferably, at least one channel is provided between the upper surface 78*b* of the actuator button 78 and the lower planar surface of the safety slide button 80. The channel cooperates with an opposed recess so as to releasably retain the safety slide button 80 in its non-locking position coaxial with the actuator button 78. The channel also enables sliding movement of the safety slide button 80 along the axis of the T-shaped slot 102 to its safety lock position, preventing depression of the actuator button 78. To this end, a cylindrical bore 104 is formed in the actuator button 78 so as to intersect the upper surface 78*b* of the actuator button 78. The cylindrical bore 104 is configured to include a channel (not shown) that is mutually cooperable with a semi-spherical recess 106 formed in the lower surface 98*b* of the cap portion 98 of the safety slide button 80.

When assembled, the plunger actuator 72, guide pin 74, coil spring 76, actuator button 78, and associated safety slide button 80 are mounted within the plunger housing 70 of the connector coupling 16. Accordingly, the threaded ends 84*a* and 84*b* of the plunger housing 70 are connected via the threads to the dispenser body 26 and end cap 15, respectively. As such, depression of the actuator button 78 when the safety slide button 80 is in a position enabling depression in a generally radial direction causes the plunger actuator 72 to move axially relative to the plunger housing 70 and engage the rear end of the irritant canister 40. This forces the discharge nozzle 42 into the passage 60 while the discharge nozzle 42 is forced into the body of the canister 40, causing pressurized irritant within the canister 40 to be discharged through the orifice 62. When the safety slide button 80 is moved to a position offset from its axially aligned position with the actuator button 78 (a "safety" position), depression of the actuator button, and thus discharge of irritant from the canister 40, is prevented. By default, the safety button 80 of the tactical defense device 10 is set to a safety position. The user easily is able to determine whether the safety slide button 80 is in a "safe" setting or in an "armed" setting both visually and tactilely. Advantageously, the tactical defense device 10 is designed to be effortlessly operable by both right-handed and left-handed users.

While a preferred embodiment of the present invention has been illustrated and described, it will be understood to those skilled in the art that changes and modifications may be made therein without departing from the invention in its broader aspects.

What is claimed is:

1. A tactical defense device for dispersing a chemical from a pressurized spray cartridge, comprising:

a dispenser adapted to receive the pressurized spray cartridge;

the dispenser having a first end defining a forward portion and an opposite second end;

the forward portion having a discharge orifice for dispersing the chemical through the discharge orifice in a generally axial direction relative to a longitudinal axis of the dispenser;

an actuator for movement in a generally axial direction relative to the longitudinal axis, between a normally inactivated position and an activated position for dispersing the chemical;

an expandable baton portion adapted for connection to the second end;

a cap accessible on a side surface of the dispenser;

the cap movable between first and second positions;

wherein, in the first position, the cap may be depressed in a generally radial direction relative to the longitudinal axis mechanically causing the actuator movement, with movement of the cap between the first and second positions being in a direction that is different than the generally radial direction;

wherein depression of the cap is prevented when the cap is in the second position; and wherein the device is generally cylindrical about the longitudinal axis.

2. The tactical defense device of claim 1, the cap being slidingly movable between the first and second positions in a generally axial direction relative to the longitudinal axis.

3. The tactical defense device of claim 1, further comprising:

an actuator button;

the cap overlying the actuator button when the cap is in the first position, with depression of the cap mechanically causing depression of the actuator button and the actuator movement.

4. The tactical defense device of claim 1, further comprising:

an actuator button;

the cap overlying the actuator button when the cap is in the first position, with depression of the cap mechanically causing depression of the actuator button and the actuator movement;

a guide pin for guiding movement of the actuator button;

a spring about the guide pin for biasing against depression of the actuator button.

5. The tactical defense device of claim 1, the cap comprising an upper surface with raised concentric rings for facilitating tactile feedback and control.

6. The tactical defense device of claim 1, the cap being positioned, on the side surface of the dispenser, to permit operation by a user's thumb of one hand while said hand is gripping the device in a generally horizontal orientation, with said hand raised and said thumb generally facing the user.

7. The tactical defense device of claim 1, the cap comprising a depending retainer leg;

the retainer leg limiting the direction of the movement of the cap between the first and second positions.

8. The tactical defense device of claim 1, further comprising:

an actuator button;

the cap overlying the actuator button when the cap is in the first position, with depression of the cap mechanically causing depression of the actuator button and the actuator movement;

the cap comprising a depending retainer leg;

the actuator button comprising a slot, adapted to slidingly receive the retainer leg to enable sliding movement of the cap between the first and second positions.

9. The tactical defense device of claim 1, further comprising:

an actuator button;

the cap overlying the actuator button when the cap is in the first position, with depression of the cap mechanically causing depression of the actuator button and the actuator movement;

the cap and the actuator button having mutually cooperable channels for releasably retaining the cap in the first position.

10. The tactical defense device of claim 1, further comprising:

a nozzle plate supported within the forward portion and defining the discharge orifice;

the nozzle plate being interchangeable with any one of a plurality of nozzle plates;

each of the plurality of nozzle plates comprising a visible outer surface, and each of the nozzle plates being distinguishable from the other nozzle plates by an appearance of its visible outer surface;

the appearances of the different nozzle plate outer surfaces respectively designed to conceal or to reveal the chemical dispersing use of the device.

11. The tactical defense device of claim 1, further comprising:

a nozzle plate supported within the forward portion and defining the discharge orifice;

the nozzle plate comprising a visible outer surface;

the visible outer surface being selected from a group consisting of a surface made of a light-reflective material, a silver color surface, a surface made of a non-reflective material, a dark buff color surface, a black color surface, a surface made of a brightly colored material, and a red color surface.

12. The tactical defense device of claim 1, further comprising:

an annular retainer in the forward portion;

a nozzle plate supported within the forward portion by the annular retainer and defining the discharge orifice.

13. The tactical defense device of claim 1, further comprising:

a nozzle plate supported within the forward portion and defining the discharge orifice;

an annular resilient seal member configured to cooperate with an annular surface of the nozzle plate.

14. The tactical defense device of claim 1, further comprising a slidingly insertable sleeve for holding the pressurized spray cartridge.

15. The tactical defense device of claim 1, wherein the dispenser has an annular cover sleeve formed thereon.

16. The tactical defense device of claim 15, wherein the annular cover sleeve is formed of a material that enhances gripping of the dispenser.

17. The tactical defense device of claim 1, wherein the discharge orifice is in axial alignment with a discharge nozzle of the pressurized spray cartridge.

18. The tactical defense device of claim 1, the dispenser comprising:

a tubular body for receiving the pressurized spray cartridge; and a coupling connector coupled to the tubular body;

the coupling connector comprising the second end of the dispenser;

the coupling connector comprising the cap.

19. The tactical defense device of claim 1, the expandable baton portion comprising telescoping sections.

20. A tactical defense device for dispersing a chemical from a pressurized spray cartridge, comprising:

a slidingly insertable sleeve for holding the pressurized spray cartridge;

a dispenser adapted to receive the slidingly insertable sleeve;

the dispenser having a first end defining a forward portion and an opposite second end;

the forward portion having a discharge orifice for dispersing the chemical through the discharge orifice in a generally axial direction relative to a longitudinal axis of the dispenser;

an actuator for movement in a generally axial direction relative to the longitudinal axis, between a normally inactivated position and an activated position for dispersing the chemical;

an actuator button for mechanically moving the actuator;

the actuator movement being caused by depression of the actuator button in a generally radial direction relative to the longitudinal axis;

a guide pin for guiding movement of the actuator button;

a spring about the guide pin for biasing against depression of the actuator button;

the second end adapted for separate interchangeable connection with each one of (a) an end cap and (b) an expandable baton portion;

the baton portion structured and dimensioned for the connected baton portion and dispenser to form a combined body for use of the device both as a dispensing apparatus for dispersion of the chemical from the pressurized spray cartridge and as an expandable baton;

the combined body being generally cylindrical about the longitudinal axis;

the end cap structured and dimensioned for closing the second end of the dispenser for use of the device only as a dispensing apparatus for dispersion of the chemical from the pressurized spray cartridge.

21. A tactical defense device for dispersing a chemical from a pressurized spray cartridge, comprising:

a slidingly insertable sleeve for holding the pressurized spray cartridge;

a dispenser adapted to receive the slidingly insertable sleeve;

the dispenser having a first end defining a forward portion and an opposite second end;

the forward portion having a discharge orifice for dispersing the chemical through the discharge orifice in a generally axial direction relative to a longitudinal axis of the dispenser;

an actuator for movement in a generally axial direction relative to the longitudinal axis, between a normally inactivated position and an activated position for dispersing the chemical;

an actuator button for mechanically moving the actuator;

a cap accessible on a side surface of the dispenser;

the cap slidingly movable between first and second positions in a generally axial direction relative to the longitudinal axis;

the cap overlying the actuator button when the cap is in the first position, with depression of the cap mechanically causing depression of the actuator button and the actuator movement;

wherein depression of the cap is prevented when the cap is in the second position;

the second end adapted for separate interchangeable connection with each one of (a) an end cap and (b) an expandable baton portion;

the baton portion structured and dimensioned for the connected baton portion and dispenser to form a combined body for use of the device both as a dispensing apparatus for dispersion of the chemical from the pressurized spray cartridge and as an expandable baton;

the combined body being generally cylindrical about the longitudinal axis;

the end cap structured and dimensioned for closing the second end of the dispenser for use of the device only as a dispensing apparatus for dispersion of the chemical from the pressurized spray cartridge.

22. A tactical defense device for dispersing a chemical from a pressurized spray cartridge, comprising:

a slidingly insertable sleeve for holding the pressurized spray cartridge;

a dispenser adapted to receive the slidingly insertable sleeve;

the dispenser having a first end defining a forward portion and an opposite second end;

the forward portion having a discharge orifice for dispersing the chemical through the discharge orifice in a generally axial direction relative to a longitudinal axis of the dispenser;

a nozzle plate supported within the forward portion and defining the discharge orifice;

the nozzle plate being interchangeable with any one of a plurality of nozzle plates;

each of the plurality of nozzle plates comprising a visible outer surface, and each of the nozzle plates being distinguishable from the other nozzle plates by an appearance of its visible outer surface;

the appearances of the different nozzle plate outer surfaces respectively designed to conceal or to reveal the chemical dispersing use of the device;

an actuator for movement in a generally axial direction relative to the longitudinal axis, between a normally inactivated position and an activated position for dispersing the chemical;

an actuator button for mechanically moving the actuator;

the second end adapted for separate interchangeable connection with each one of (a) an end cap and (b) an expandable baton portion;

the baton portion structured and dimensioned for the connected baton portion and dispenser to form a combined body for use of the device both as a dispensing apparatus for dispersion of the chemical from the pressurized spray cartridge and as an expandable baton;

the combined body being generally cylindrical about the longitudinal axis;

the end cap structured and dimensioned for closing the second end of the dispenser for use of the device only as a dispensing apparatus for dispersion of the chemical from the pressurized spray cartridge.

23. A tactical defense device for dispersing a chemical from a pressurized spray cartridge, comprising:

a slidingly insertable sleeve for holding the pressurized spray cartridge;

a dispenser adapted to receive the slidingly insertable sleeve;

the dispenser having a first end defining a forward portion and an opposite second end;

the forward portion having a discharge orifice for dispersing the chemical through the discharge orifice in a generally axial direction relative to a longitudinal axis of the dispenser;

a nozzle plate supported within the forward portion and defining the discharge orifice;

the nozzle plate comprising a visible outer surface;

the visible outer surface being selected from a group consisting of a surface made of a light-reflective material, a silver color surface, a surface made of a non-reflective material, a dark buff color surface, a black color surface, a surface made of a brightly colored material, and a red color surface;

an actuator for movement in a generally axial direction relative to the longitudinal axis, between a normally inactivated position and an activated position for dispersing the chemical;

an actuator button for mechanically moving the actuator;

the second end adapted for separate interchangeable connection with each one of (a) an end cap and (b) an expandable baton portion;

the baton portion structured and dimensioned for the connected baton portion and dispenser to form a combined body for use of the device both as a dispensing apparatus for dispersion of the chemical from the pressurized spray cartridge and as an expandable baton;

the combined body being generally cylindrical about the longitudinal axis;

the end cap structured and dimensioned for closing the second end of the dispenser for use of the device only as a dispensing apparatus for dispersion of the chemical from the pressurized spray cartridge.

24. A tactical defense device for dispersing a chemical from a pressurized spray cartridge, comprising:

a slidingly insertable sleeve for holding the pressurized spray cartridge;

a dispenser adapted to receive the slidingly insertable sleeve;

the dispenser having a first end defining a forward portion and an opposite second end;

the forward portion having a discharge orifice for dispersing the chemical through the discharge orifice in a generally axial direction relative to a longitudinal axis of the dispenser;

an annular retainer in the forward portion;

a nozzle plate supported within the forward portion by the annular retainer and defining the discharge orifice;

an actuator for movement in a generally axial direction relative to the longitudinal axis, between a normally inactivated position and an activated position for dispersing the chemical;

an actuator button for mechanically moving the actuator;

the second end adapted for separate interchangeable connection with each one of (a) an end cap and (b) an expandable baton portion;

the baton portion structured and dimensioned for the connected baton portion and dispenser to form a combined body for use of the device both as a dispensing apparatus for dispersion of the chemical from the pressurized spray cartridge and as an expandable baton;

the combined body being generally cylindrical about the longitudinal axis;

the end cap structured and dimensioned for closing the second end of the dispenser for use of the device only as a dispensing apparatus for dispersion of the chemical from the pressurized spray cartridge.

25. A tactical defense device for dispersing a chemical from a pressurized spray cartridge, comprising:

a slidingly insertable sleeve for holding the pressurized spray cartridge;

a dispenser adapted to receive the slidingly insertable sleeve;

the dispenser having a first end defining a forward portion and an opposite second end;

the forward portion having a discharge orifice for dispersing the chemical through the discharge orifice in a generally axial direction relative to a longitudinal axis of the dispenser;

a nozzle plate supported within the forward portion and defining the discharge orifice;

an annular resilient seal member configured to cooperate with an annular surface of the nozzle plate;

an actuator for movement in a generally axial direction relative to the longitudinal axis, between a normally inactivated position and an activated position for dispersing the chemical;

an actuator button for mechanically moving the actuator;

the second end adapted for separate interchangeable connection with each one of (a) an end cap and (b) an expandable baton portion;

the baton portion structured and dimensioned for the connected baton portion and dispenser to form a combined body for use of the device both as a dispensing apparatus for dispersion of the chemical from the pressurized spray cartridge and as an expandable baton;

the combined body being generally cylindrical about the longitudinal axis;

the end cap structured and dimensioned for closing the second end of the dispenser for use of the device only as a dispensing apparatus for dispersion of the chemical from the pressurized spray cartridge.

26. A tactical defense device for dispersing a chemical from a pressurized spray cartridge, comprising:

a dispenser adapted to receive the pressurized spray cartridge;

the dispenser having a first end defining a forward portion and an opposite second end;

the forward portion having a discharge orifice for dispersing the chemical through the discharge orifice in a generally axial direction relative to a longitudinal axis of the dispenser;

a nozzle plate supported within the forward portion and defining the discharge orifice;

the nozzle plate being interchangeable with any one of a plurality of nozzle plates;

each of the plurality of nozzle plates comprising a visible outer surface, and each of the nozzle plates being distinguishable from the other nozzle plates by an appearance of its visible outer surface;

the appearances of the different nozzle plate outer surfaces designed respectively to conceal or to reveal the chemical dispersing use of the device;

an actuator for movement in a generally axial direction relative to the longitudinal axis, between a normally inactivated position and an activated position for dispersing the chemical;

an expandable baton portion adapted for connection to the second end;

wherein the device is generally cylindrical about the longitudinal axis.

27. The tactical defense device of claim 26, further comprising a slidingly insertable sleeve for holding the pressurized spray cartridge.

28. The tactical defense device of claim 26, further comprising:

a cap accessible on a side surface of the dispenser;

the cap movable between first and second positions;

wherein, in the first position, the cap may be depressed in a generally radial direction relative to the longitudinal axis mechanically causing the actuator movement, with movement of the cap between the first and second positions being in a direction that is different than the generally radial direction;

wherein depression of the cap is prevented when the cap is in the second position.

29. The tactical defense device of claim 28, further comprising:

an actuator button;

the cap overlying the actuator button when the cap is in the first position, with depression of the cap mechanically causing depression of the actuator button and the actuator movement.

30. The tactical defense device of claim 28, the cap being positioned, on the side surface of the dispenser, to permit operation by a user's thumb of one hand while said hand is gripping the device in a generally horizontal orientation, with said hand raised and said thumb generally facing the user.

31. The tactical defense device of claim 28, the dispenser comprising:

a tubular body for receiving the pressurized spray cartridge; and a coupling connector coupled to the tubular body;

the coupling connector comprising the second end of the dispenser;

the coupling connector comprising the cap.

32. The tactical defense device of claim 26, wherein the dispenser has an annular cover sleeve formed thereon.

33. The tactical defense device of claim 32, wherein the annular cover sleeve is formed of a material that enhances gripping of the dispenser.

34. The tactical defense device of claim 26, wherein the discharge orifice is in axial alignment with a discharge nozzle of the pressurized spray cartridge.

35. The tactical defense device of claim 26, the visible outer surface being selected from a group consisting of a surface made of a light-reflective material, a silver color surface, a surface made of a non-reflective material, a dark buff color surface, a black color surface, a surface made of a brightly colored material, and a red color surface.

36. The tactical defense device of claim 26 wherein the forward portion is enlarged.

37. The tactical defense device of claim 26, further comprising:

an annular retainer in the forward portion;

the nozzle plate supported within the forward portion by the annular retainer.

38. The tactical defense device of claim 26, further comprising an annular resilient seal member configured to cooperate with an annular surface of the nozzle plate.

* * * * *